US006034476A

United States Patent [19]

Tamura

[11] Patent Number: 6,034,476

[45] Date of Patent: Mar. 7, 2000

[54] NOBLE GAS DISCHARGE LAMP

[75] Inventor: Satoshi Tamura, Osaka, Japan

[73] Assignee: NEC Corporation, Japan

[21] Appl. No.: 09/054,908

[22] Filed: Apr. 3, 1998

[30] Foreign Application Priority Data

Apr. 7, 1997 [JP] Japan ..... 9-088398

[51] Int. Cl.[7] ..... H01J 11/00

[52] U.S. Cl. ..... 313/607; 313/488

[58] Field of Search ..... 313/488, 594, 313/607, 493, 634

[56] References Cited

U.S. PATENT DOCUMENTS 5,117,160 5/1992 Konda et al. ..... 315/326
5,932,960 8/1999 Tarada et al. ..... 313/485

FOREIGN PATENT DOCUMENTS 521553 1/1993 European Pat. Off. .
604902 7/1994 European Pat. Off. .

OTHER PUBLICATIONS

Derwent Publications Ltd., London, GB, AN 95–028181, English Abstract of JP 06–314561, Nov. 8, 1994.
*Patent Abstracts of Japan*, vol. 095, No. 002, Mar. 31, 1995 (JP 06–314561) [Same As Above].

*Primary Examiner*—Vip Patel
*Attorney, Agent, or Firm*—Ostrolenk, Faber, Gerb & Soffen, LLP

[57] ABSTRACT

A noble gas discharge lamp of the present invention comprises an outer enclosure comprising a light emitting layer formed therein, and a pair of outer electrodes having tape shapes comprise a metal, which are adhered to the entire length of the outside of the outer enclosure so as to separate one outer electrode and the other outer electrode at a certain distance, and to form a first opening portion and a second opening portion; wherein the thickness of the outer enclosure is in a range of 0.2 to 0.7 mm, and at least one nonlinear portion is formed at at least one the side portion of the outer electrodes.

11 Claims, 9 Drawing Sheets

NOBLE GAS DISCHARGE LAMP

BACKGROUND OF THE INVENTION

1. Field of the Invention

The present invention relates to a noble gas discharge lamp. More particularly, the present invention relates to a noble gas discharge lamp comprising a light emitting layer comprising an aperture inside a glass bulb, and a pair of outer electrodes in the shape of a belt outside the glass bulb, in which the outer enclosure and the outer electrodes are improved in their structure so as to produce a stable travel of electric discharge.

This application is based on patent application No. 09-088398 filed in Japan, the content of which is incorporated herein by reference.

2. Description of the Related Art

The applicants of the present invention previously proposed the noble gas discharge lamp shown in FIGS. 14 to 16. In FIGS. 14 to 16, reference number 1 indicates a hermetic outer enclosure in the shape of a straight tube, and is comprised of a glass bulb, for example. On the inside of the outer enclosure 1, a light emitting layer 2 is formed which is comprised of one or more kinds of fluorescent substances such as fluorescent rare earth substances and fluorescent halorine acid salt substances. In particular, an aperture 2*a* having a certain opening angle is formed to extend over the full length of the light emitting layer 2.

The outer enclosure 1 is sealed by adhering glass plates in the shape of a disc to the ends of the glass bulb. However, for example, the outer enclosure 1 can also be sealed by tapering and cutting the ends of the glass bulb, while heating.

Moreover, the internal part of the outer enclosure 1 is filled with one kind of noble gas such as xenon (Xe), krypton (Kr), neon (Ne), helium (He), and the like, or a mixture thereof in which a metallic vapor such as mercury is not contained. Among these noble gases, noble gas comprising xenon as a main component is preferable.

An outer laminate 3 is rolled closely into the outside of the outer enclosure 1. The outer laminate 3 may be composed of a light transmitting sheet 4, a pair of outer electrodes 5 and 6, terminals 51 and 61, and an adhesive layer 9.

The light transmitting sheet 4 has a length equal to a length of the outer enclosure 1, and a thickness in a range of 20 to 100 microns. This light transmitting sheet 4 has electrical insulating properties, and may be suitably comprised of polyethylene terephtalate (PET); however, polyester resin can be also used.

The above-mentioned pair of outer electrodes 5 and 6 are comprised of a metallic member having a light insulating property, the appearance thereof is tape shape, and it is adhered to one surface of the light transmitting sheet 4 so as to separate one outer electrode 5 from the other outer electrode 6 at a certain interval.

The terminals 51 and 61 are connected electrically to the end of the outer electrodes 5 and 6. They are arranged at the edge of the light transmitting sheet 4 so that the ends thereof project from the edge of the light transmitting sheet 4. The thickness of the terminals 51 and 61 is preferably in a range of 0.1 to 0.5 mm.

The outer electrodes 5 and 6 and the terminals 51 and 61 are comprised of metals having differing corrosion potentials; for instance, aluminum foil in the shape of a tape is suitable for the outer electrodes 5 and 6. In addition to aluminum, nickel and other metals which have excellent electroconductivity and light insulating properties can comprise the outer electrodes 5 and 6. Regarding the terminals 51 and 61, copper in the shape of a strip is suitable. However, in addition to copper, metals such as silver, stainless steel, Cu-Ni alloy, and the like can comprise the terminals 51 and 61.

In particular, in the relationships of the widths between the outer electrodes 5 and 6 and the terminals 51 and 61, the width (w) of the outer electrodes 5 and 6, and the width (d) of the terminals 51 and 61 preferably satisfy with the formula: $0.1\ w \leqq d \leqq 0.5\ w$. The adhesive layer 9 has sticky properties and/or adhesive properties, and is adhered to one surface of the light transmitting sheet 4. The adhesive layer 9 is suitably comprised of a silicon adhesive agent; however, acryl resin adhesive agents and the like can also be used.

Moreover, plating layer (not shown in the Figures) is formed on terminals 51 and 61. The plating layer is comprised of metals which are different from metals comprising the outer electrodes 5 and 6 and the terminals 51 and 61, and of which the corrosion potential difference is between the corrosion potential differences of the metals comprising the outer electrodes 5 and 6 and the terminals 51 and 61. For instance, in the case in which the outer electrodes 5 and 6 are comprised of aluminum foil and the terminals 51 and 61 are comprised of copper, nickel and lead-tin solder can be listed as metals suitable for comprising the plating layer. The plating layer can be formed preferably by electroplating or electroless plating; however, the plating layer can also be formed by an immersion or a flame spray.

The thickness of the plating layers is preferably in a range of 5 to 30 microns, more preferably in a range of 10 to 20 microns. However, a plating layer having a thickness outside the range can also be used.

The aforementioned outer laminate 3 is formed onto the outside of the outer enclosure 1 so that the outer electrodes 5 and 6 are positioned between the outer enclosure 1 and the light transmitting sheet 4. One edge 4*a* of the light transmitting sheet 4 is laminated and adhered to the other edge 4*b* at the following second opening portion 8. Moreover, in a condition in which the outer laminate 3 is adhered to the outer enclosure 1, a first opening portion 7 is formed by the side portions of the outer electrodes 5 and 6, and the second opening portion 8 is formed by the other side portions of outer electrodes 5 and 6. The light from the light emitting layer 2 is emitted mainly from the first opening portion 7 via the aperture 2*a*.

The noble gas discharge lamp comprising the above-mentioned components can be produced by the following steps.

A water soluble fluorescent paint is made by mixing fluorescent substances having an emission spectrum in a blue range, a green range, and a red range, for example. Next, the light emitting layer 2 is formed by coating a water soluble fluorescent paint on the inside of the outer enclosure 1 comprised of a glass bulb, by drying and then firing.

The aperture 2*a* is formed by peeling off and by forcibly removing a part of the light emitting layer 2, while maintaining a certain opening angle, by using a scraper (not shown in the Figures). The obtained outer enclosure 1 is sealed and is filled with a certain amount of noble gas such as xenon and the like.

As shown in FIGS. 15 and 16, the outer laminate 3 is formed by positioning one pair of the outer electrodes 5 and 6 on the light transmitting sheet 4 so as to be disposed with a certain space therebetween, so that the terminals 51 and 61 project out from the edge of the outer electrodes 5 and 6, and by forming the adhesive layer 9 onto the upper surfaces of the light transmitting sheet 4 and the outer electrodes 5 and 6.

As shown in FIG. 17, the unfolding of outer laminate 3 obtained by the above-mentioned steps is positioned on the stage 10. The outer enclosure 1 is positioned on the outer laminate 3 so that the outer enclosure 1 is positioned on the edge 4*a* of the light transmitting sheet 4, and the longitudinal axis of the outer enclosure 1 is parallel to the longitudinal axis of the outer electrodes 5 and 6. Rollers 11 and 11 are positioned so that the outer enclosure 1 is contacted with some pressure to the light transmitting sheet 4, while maintaining the above conditions.

While maintaining the above conditions, as shown in FIG. 17, the stage 10 is moved in the direction M, and is then moved in the direction N. Because of these movements, the outer laminate 3 is wound around the outside of the outer enclosure 1, and one edge 4*a* is piled on the other edge 4*b* of the light transmitting sheet 4, as shown in FIG. 14. Then, the noble gas discharge lamp is produced by adhering the edges 4*a* and 4*b* of the light transmitting sheet 4 with the adhesive layer 9.

According to the noble gas discharge lamp having the above-mentioned components, light emitted from the light emitting layer 2 is concentrated in the outer enclosure 1, and is emitted from the outside of the noble gas discharge lamp via the first opening portion 7 and the aperture 2*a*. Therefore, when the noble gas discharge lamp is used in an office automation device such as an illumination device, the intensity of illumination on a document being scanned can be increased. As a result, accurate scanning of documents can be improved.

Moreover, it is anticipated that the noble gas discharge lamp will have the following effects.

The plating layer is formed between the outer electrodes 5 and 6 and the terminals 51 and 61; therefore, even if the outer electrodes 5 and 6 and the terminals 51 and 61 which are comprised of metals having different corrosion potential from each other, are connected directly, generation of corrosion due to the contact of different kinds of metal can be prevented.

In particular, when the width (w) of the outer electrodes 5 and 6 and the width (d) of the terminals 51 and 61 are set to satisfy the following formula: $0.1\ w \leqq d \leqq 0.5\ w$, generation of corrosion due to contact of different kinds of metal can be effectively prevented, in company with the existence of the plating layer. Therefore, a stable travel of electric discharge of the noble gas discharge lamp can be maintained for long periods.

However, when the width (d) of the terminals 51 and 61 is less than 0.1 w, contact intensity to the outer electrodes 5 and 6 of the terminals 5 land 61 is decreased. In contrast, when the width (d) of the terminals 51 and 61 is more than 0.5 w, in winding the outer laminate 3 around the outside of the outer enclosure 1, the terminals 51 and 61 could not be wound around the outside of the outer enclosure 1 easily. This process is extremely troublesome. Therefore, it is preferable that width (w) of the outer electrodes 5 and 6 and the width (d) of the terminals 51 and 61 satisfy the above-mentioned formula.

Moreover, the following effects can be obtained in the process for products. The adhesive layer 9 is formed on one surface of the light transmitting sheet 4; therefore, the outer laminate 3 can be adhered closely to the outside of the outer enclosure 1 by a simple step, that is, simply by rolling the outer enclosure 1 onto the outer laminate 3. In addition, the outer electrodes 5 and 6 are positioned previously so as to be disposed at a certain interval from each other on the light transmitting sheet 4; therefore, in adhering the outer laminate 3 to the outer enclosure 1, it is not necessary to adjust the positioning of the outer electrodes 5 and 6 to maintain a certain interval therebetween. Therefore, it can be anticipated that not only will the work efficiency be greatly improved, but automated production of the noble gas discharge lamp will also be possible. That is, production of the noble gas discharge lamp in large quantities may be anticipated.

As shown in FIG. 18, the resulting noble gas discharge lamp is switched on to produce light by applying a high voltage of high frequency (for example, a frequency of 30 kHz and a voltage of 2500 $V_{o\text{-}p}$) to the outer electrodes 5 and 6, from an inverter circuit 12, via the terminals 51 and 61.

For instance, the voltage applied to the outer electrodes 5 and 6 is approximately 2500 Vp in a noble gas discharge lamp of which the outer enclosure 1 is 8 mm in external diameter and 360 mm in total length.

Moreover, this noble gas discharge lamp is different from lamps having one discharge along the longitudinal direction of the outer enclosure 1, such as a noble gas discharge lamp having a hot cathode or a cold cathode. More specifically, innumerable discharges occur between the outer electrodes 5 and 6 (discharges are generated approximately perpendicularly to the longitudinal direction of the outer enclosure 1); therefore, when such a light is turned on, light is emitted in a striped pattern in the above-mentioned noble gas discharge lamp. Electric discharges in a striped pattern cannot be confirmed under normal lighting conditions.

However, when the output electric power from the inverter circuit 12 is decreased 10%, for example, by a change of voltage from a power source, the electric discharges in a striped pattern can be confirmed. Moreover, the electric discharging positions (points) are not stable and travel in the longitudinal direction of the outer enclosure 1, without interruption. The light emitting from aperture 2*a* is therefore intermittent.

In particular, in the case of employing the noble gas discharge lamp in an illumination device for the office equipment such as facsimile machines, image-scanners, and the like, the light intensities at the points in the longitudinal direction of the aperture 2*a* change continuously. Therefore, it is possible that the scan accuracy of the illuminated document is extremely degraded, and the quality of reproduction may be also degraded.

SUMMARY OF THE INVENTION

It is therefore an object of the present invention to provide a noble gas discharge lamp having a simple construction, which can produce a stable travel of electric discharge, and lamps improving light output.

According to an aspect of the present invention, the present invention provides a noble gas discharge lamp comprising of: an outer enclosure comprising a light emitting layer formed therein, and a pair of outer electrodes in the shape of a tape comprising a metal, which are adhered to the total length of the outside of the outer enclosure so as to be separated at a certain interval, and to form a first opening portion and a second opening portion, wherein the thickness of the outer enclosure is in a range of 0.2 to 0.7 mm, and at least one nonlinear edge portion is formed at at least one side portion of the outer electrodes.

Moreover, the nonlinear edge portion is formed at at least one side of the outer electrodes, in which some projections project toward the opposite electrode.

In particular when facility of production and starting characteristics of the noble gas discharge lamps are taken into consideration, it is preferable that the projections project toward the opposite electrode along the outside of the outer enclosure. Moreover, dents are formed among the projections of the nonlinear edge portion.

DESCRIPTION OF THE PREFERRED EMBODIMENTS

A detailed explanation will now be made of the noble gas discharge lamp of the present invention.

The first embodiment of the noble gas discharge lamp of the present invention is explained below with reference to FIGS. 1 and 2. The components in FIGS. 1 and 2 identical to those in FIGS. 14 to 17 are numbered with the same reference numbers as in FIGS. 14 to 17, and detailed explanations thereof will be omitted.

Figure 1:
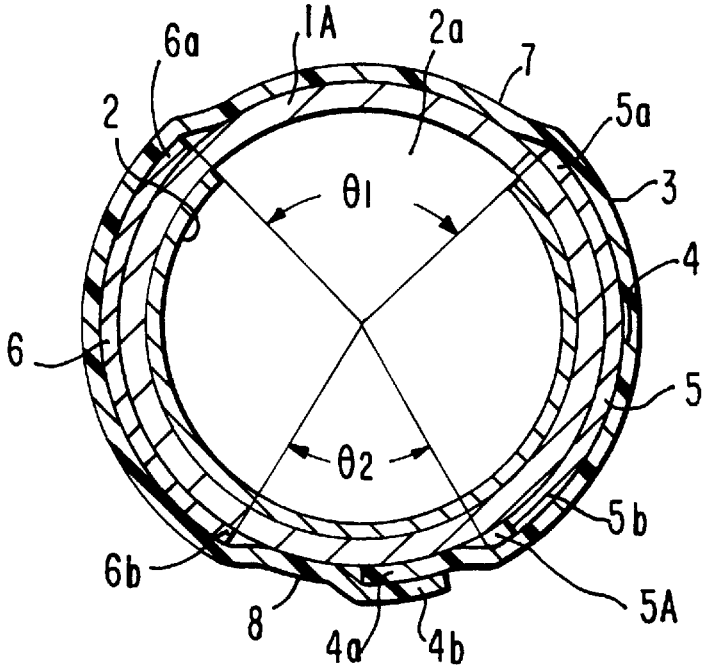
FIG. 1 is a cross-sectional diagram showing the noble gas discharge lamp of the first embodiment of the present invention.
Figure 2:
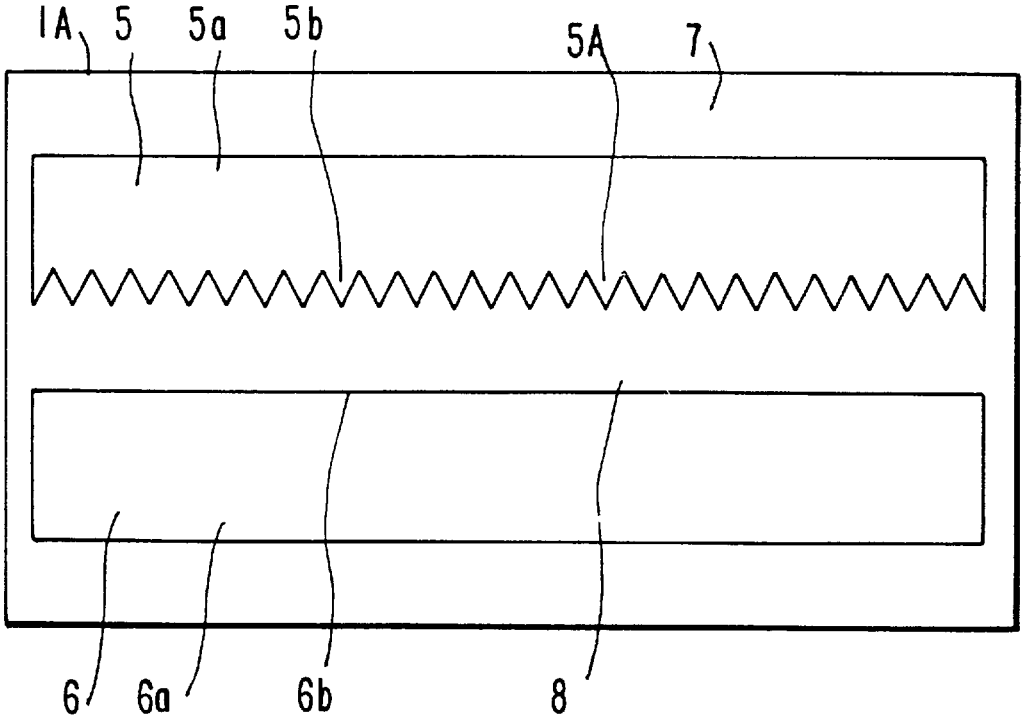
FIG. 2 is a schematic view showing the outer enclosure and outer electrodes shown in FIG. 1.

The characteristic components of the noble gas discharge lamp shown in FIGS. 1 and 2 are as follows:

The thickness of the outer enclosure 1A comprised of a glass bulb (tube), for example, is set in a range of 0.2 to 0.7 mm, preferably in a range of 0.4 to 0.7 mm. From among the side portions 5*b* and 6*b* of the outer electrodes 5 and 6 which form the second portion 8, a nonlinear portion 5A in which triangles are formed is formed at only side portion 5*b*. The remaining portion 6*b* of the outer electrode 6 is formed linearly.

The nonlinear portion 5A has a periodicity. More specifically, when the outer diameter of the outer enclosure 1A is 8 mm, it is preferable that the width of the outer electrode 5 including the nonlinear portion 5A be 8 mm, the pitch thereof be 4 mm, and the height thereof (the height of the triangle) be 1.5 mm. However, the sizes of the nonlinear portion 5A can be changed, depending on the situation or the object of using the noble gas discharge lamp and illumination device comprised thereof.

Moreover, the interval between the apexes of the nonlinear portion 5A formed at the side portion 5*b* and the linear side portion 6*b* being opposite the nonlinear portion 5A is fixed over the entire outer electrodes 5 and 6.

The outer enclosure 1A is comprised of materials having a large dielectric constant, reliable hermetic sealing properties, and light transmitting properties. However, it is preferable to use a lead glass having a large dielectric constant, for example.

The thickness of the outer enclosure 1A is set in a range of 0.2 to 0.7 mm, preferably in a range of 0.4 to 0.7 mm. Excellent productivity and light properties can be obtained in this range.

However, when the thickness of the outer enclosure 1A is less than 0.4 mm, especially below 0.2 mm, the mechanical strength of the outer enclosure 1A is extremely decreased. Therefore, when the outer enclosures 1A are put into commercial production, the production rate of poor quality goods (broken glass, for example) increases. In contrast, when the thickness thereof is more than 0.7 mm, electric discharges in a striped pattern can be confirmed. Moreover, light emitted from the aperture 2*a* becomes very intermittent. Therefore, it is preferable that the thickness of the outer enclosure 1A be in that range.

The internal part of the outer enclosure 1A is filled with one kind of noble gas, such as xenon (Xe), krypton (Kr), neon (Ne), helium (He), and the like, or a mixture thereof. The outer enclosure 1A is filled with the gas under the confining pressure being in a range of 83 to 200 Torr.

When the confining pressure is in this range, starting characteristics and light output (illumination intensity on the illuminated document) can be improved, and occurrence of intermittent illumination can be reduced. However, when the confining pressure is less than 83 Torr, light output is not sufficiently improved. In contrast, when the confining pressure is more than 200 Torr, not only are starting characteristics, inferior, but the electric discharges in a striped pattern are confirmed, and the light emitted from the aperture 2*a* becomes very intermittent. Therefore, it is preferable that the confining pressure of the noble gas be in that range.

The light emitting layer 2 may include one or more kinds of fluorescent substances, depending on the manner in which the noble gas discharge lamp is to be used.

Examples of the fluorescent substance comprising the light emitting layer 2 are fluorescent borates such as fluorescent europium activated yttrium.gallium borate, and the like; fluorescent phosphate such as fluorescent cerium.terbium activated lanthanum phosphate ($LaPO_4$: Ce,Tb), fluorescent tin activated strontium.magnesium phosphate ($(SrMg)_3(PO_4)_2$: Sn), fluorescent europium activated strontium boric phosphate ($2SrO.(P_2O_7.B_2O_3)$ : Eu), and the like; fluorescent europium activated yttrium phosphovanadate ($Y(PV)O_4$: Eu); fluorescent cerium.terbium activated magnesium aluminate ($MgAl_{11}O_{19}$: Ce, Th); fluorescent cerium.terbium activated yttrium.silicate ($Y_2SiO_5$: Ce, Th); fluorescent europium activated barium-magnesium aluminate ($BaMg_2Al_{16}O_{27}$: Eu); fluorescent europium activated yttrium oxide ($Y_2O_3$: Eu), and the like.

More specifically, for instance, in the case of a three-wavelength illumination system, the light emitting layer comprises a mixture of fluorescent substances, that is, fluorescent europium activated barium-magnesium aluminate having a blue emission spectrum; fluorescent cerium.terbium activated lanthanum phosphate having a green emission spectrum; and fluorescent europium activated yttrium-.gallium borate having a red emission spectrum.

The coated amount of the fluorescent substance is set in a range of 5 to 30 mg/cm$^2$. In this range, the desired light output can be obtained. However, when the coated amount is less than 5 mg/cm$^2$, the light output decreases; therefore, the illumination intensity on the illuminated document is insufficient. In contrast, when the coated amount is more than 30 mg/cm$^2$, light emitting layer 2 having uniform quality cannot be easily obtained. Therefore, the coated amount of the fluorescent substances is preferably in this range.

Moreover, the light emitting layer 2 can be formed at a part of the inside of the outer enclosure 1A, or over the inside thereof.

In addition, the first and second opening portion 7 and 8 are formed at the interval portions between the outer electrodes 5 and 6. The opening angle $\theta_1$ of the first opening portion 7 is larger than the opening angle $\theta_2$ of the second opening portion 8.

Among the angles satisfying the above conditions, it is preferable that the opening angle $\theta_1$ of the first opening portion 7 be in the range of 60° to 90°, and the opening angle $\theta_2$ of the second opening portion 8 be approximately 55°. However, the opening angle $\theta_1$ of the first opening portion 7 can be outside the range, depending on the situation of using the noble gas discharge lamp. It is preferable that the second opening portion 8 be narrow so as not to cause breaks in insulation; therefore, the distance between one outer electrode 5 and the other electrode 6 in the second opening portion 8 is preferably 2 mm or more.

Moreover, the opening angle of the aperture 2*a* is equivalent to the first angle $\theta_1$ of the first opening portion 7, in the noble gas discharge lamp as shown in FIG. 1.

In this embodiment, from among the side portions 5*b* and 6*b* of the outer electrodes 5 and 6 which form the second portion 8, the nonlinear portion 5A in which some projections project toward the opposite electrode, is formed at the side portion 5*b*. More specifically, as shown in FIG. 2, the nonlinear portion 5A having a series of repeated triangles is formed at the side portion 5*b* of the outer electrode 5.

Therefore, when a high voltage of high frequency is applied to the outer electrodes 5 and 6, an electrical field is easily concentrated at the peaks of the triangles of the nonlinear portion 5A. Therefore, when some electric power input to the outer electrodes 5 and 6 is decreased by fluctuating output electric power, the noble gas discharge lamp of this embodiment can be certainly lit.

In addition, the thickness of the outer enclosure 1A is in a range of 0.2 to 0.7 mm. Therefore, in the case that the thickness of the outer enclosure 1A is at the top of this range, when a high voltage of high frequency is applied to the outer electrodes 5 and 6, intermittent illumination easily occurs, depending on the increase of voltage to the outer enclosure 1A caused by increase of resistive components. However, even if the outer enclosure 1A is at the top of that range, intermittent illumination can be effectively prevented by the thickness being in that range, in company with the existence of the nonlinear portion 5A at the side portion 5*b* of the outer electrode 5. In addition, light output from the first opening portion 7 via the aperture 2*a* can be effectively improved.

Moreover, the nonlinear portion 5A having triangles is formed at the side portion 5*b* from among the side portions 5*b*, 6*b* of the outer electrodes 5 and 6 which form the second portion 8; however, the side portions 5*a* and 6*a* of the outer electrodes 5 and 6 forming the first opening portion 7 are formed linearly (this shape does not influence light emission). Therefore, even when the noble gas discharge lamps are used in an illumination device, illumination of a document can be approximately uniform without further measures being taken. As a result, the precision of scanning of an illuminated document can be improved by simple components.

In particular, when the confining pressure of noble gas is high, light output increases, but the starting characteristics of the noble gas discharge lamp are degraded. However, even if the confining pressure of the noble gas is set to 200 Torr, starting characteristics of a practical level can be obtained by forming the nonlinear portion 5A in triangles at the side portion 5*b* of the outer electrode 5. Moreover, occurrence of intermittent illumination is effectively prevented, and the light output can be improved. Therefore, when the noble gas discharge lamp of this embodiment is used in an illumination device, stable travel of electric discharge can be obtained, and the illumination intensity on the illuminated document can be increased; therefore, the precision of scanning of an illuminated document can be improved.

When the coated amount of the fluorescent substance is in a range of 5 to 30 mg/cm$^2$; the light output from the first opening portion 7 via the aperture 2*a* can be effectively improved by setting the thickness of the outer enclosure 1A to a range of 0.2 to 0.7 mm, in company with setting the confining pressure of noble gas in a range of 83 to 200 Torr.

In particular, the above-mentioned range of the coated amount of the fluorescent substances is 2 to 10 times as much as the amount of the fluorescent substances employed in ordinary fluorescent lamps for illumination. It is believed that the coated amount is not preferable for ordinary fluorescent lamps for illumination. However, the light output is effectively increased in the noble gas discharge lamp of the embodiment. A cause of this phenomena is not clear; however, it may be believed that this phenomena is characteristic of a noble gas discharge lamp in which innumerable discharges are formed between the outer electrodes 5 and 6 (approximately perpendicular to the longitudinal direction of the outer enclosure 1A); therefore, a striped pattern is produced.

When the thickness of the outer enclosure 1A is in that range, the shapes of the outer electrodes 5 and 6 is formed as described above, and the coated amount of the fluorescent substances and the confining pressure of the noble gas are preferably set in those ranges, in addition to set the opening angle $\theta_1$ of the first opening portion 7 in a range of 60 to 90°, the light output emitted from the first opening portion 7 can be effectively increased.

Under these conditions, the leakage of light from the second portion 8 is prevented, and light output emitted from the first opening portion 7 can be more effectively increased by setting the size of the second portion 8, that is, the interval between the peak of the nonlinear portion 5A and the side portion 6*b,* to approximately 2 mm.

Figure 3:
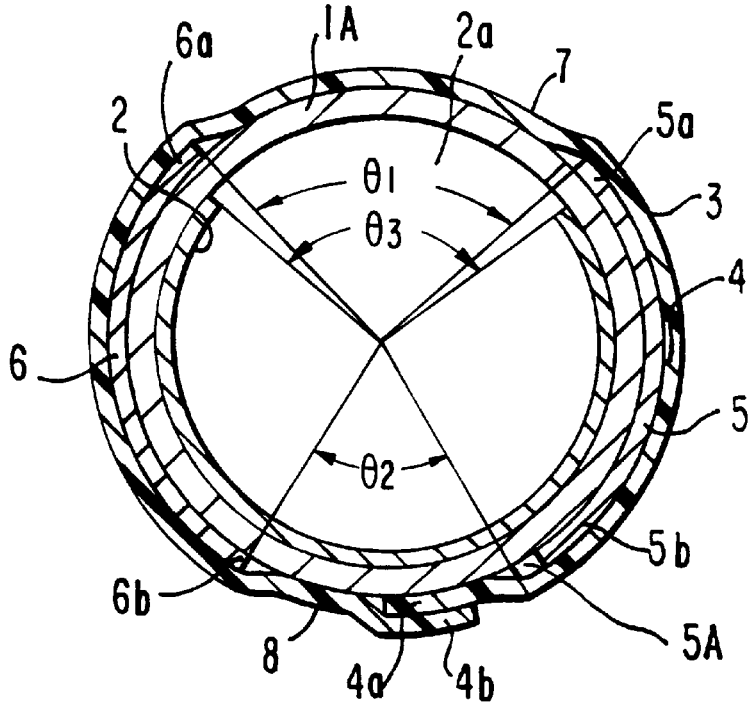
FIG. 3 is a cross-sectional diagram showing the noble gas discharge lamp of the second embodiment of the present invention.

FIG. 3 shows the second embodiment of the present invention, and the basic components of the noble gas discharge lamp shown in FIG. 3 are the same as those of the noble gas discharge lamp shown in FIG. 1.

However, they differ in the following point: The opening angle $\theta_3$ of the aperture 2*a* formed in the inside of the outer enclosure 1A at the position corresponding to the first opening portion 7, is larger than the opening angle $\theta_1$ of the first opening portion 7.

The opening angle $\theta_3$ of the aperture 2*a* is set in a range of 70° to 110°, for example; however, the angle $\theta_3$ can be changed depending on the situation or the object of using the noble gas discharge lamp.

Moreover, it is preferable that the opening angle $\theta_1$ of the first opening portion 7 and the opening angle $\theta_2$ of the second opening portion 8 satisfy the relationship of $\theta_1>\theta_2$; however, they may be set to satisfy the relationship of $\theta_1 \leqq \theta_2$ in this embodiment.

In this embodiment, in winding the outer laminate 3 onto the outside of the outer enclosure 1A, even if the center of the first opening portion 7 is a little off-center with respect to the center of the aperture 2*a,* a discrepancy of the optical axis of the light emitted from the first opening portion 7 can be mitigated. Therefore, it is possible to obtain full scanning accuracy when the noble gas discharge lamp of the second embodiment is used as an illumination device.

Figure 4:
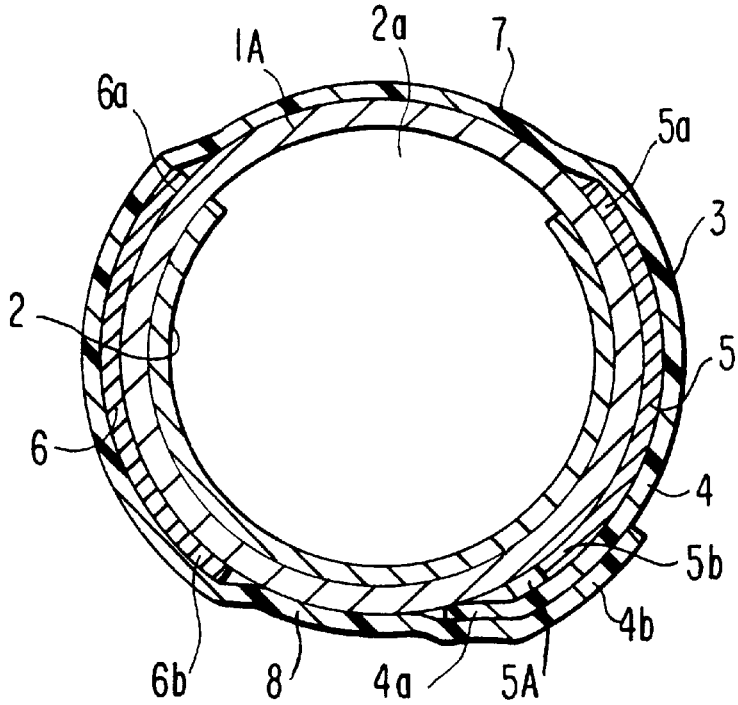
FIG. 4 is a cross-sectional diagram showing the noble gas discharge lamp of the third embodiment of the present invention.

FIG. 4 shows the third embodiment of the present invention, and the basic components of the noble gas discharge lamp shown in FIG. 4 are the same as those of the noble gas discharge lamp shown in FIG. 1.

However, they differ in following point: One edge 4*a* and the outer edge 4*b* of the light transmitting sheet 4 are laminated to each other on the outer electrode 5, and they are melted and adhered by ultrasonic waves.

In this embodiment, the laminated portions 4*a* and 4*b* are melted and adhered by ultrasonic waves on the outside of the outer electrode 5; therefore, an oscillation of ultrasonic waves applying the light emitting layer 2 positioning inside of the outer electrode 1A is relieved. In comparing the noble gas discharge lamps of the first and the second embodiments, the oscillation of ultrasonic waves applying the light emitting layer 2 positioning inside of the outer electrode 1A is relieved. As a result, a peeling off of the light emitting layer 2 from the inside of the outer enclosure 1A is substantially prevented, and light output can be improved.

Moreover, in the above embodiment, the laminated portions 4*a* and 4*b* of the light transmitting sheet 4 are melted and adhered by ultrasonic waves; however, adhesion by an adhesive agent, by heat, or simultaneous use of both may also be employed.

Figure 5:
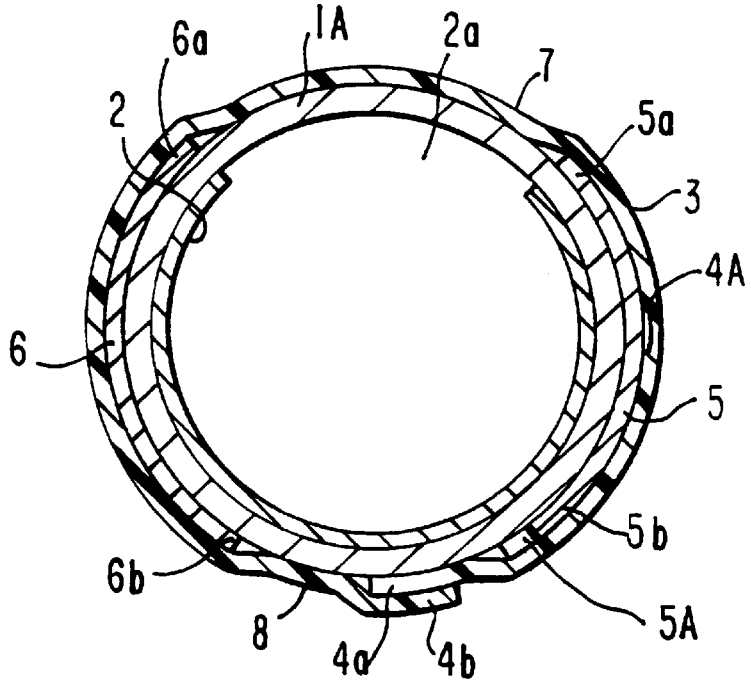
FIG. 5 is a cross-sectional diagram showing the noble gas discharge lamp of the fourth embodiment of the present invention.

FIG. 5 shows the fourth embodiment of the present invention, and the basic components of the noble gas discharge lamp shown in FIG. 5 are the same as those of the noble gas discharge lamp shown in FIG. 1.

However, they differ in the following point: A pair of the outer electrodes 5 and 6 is adhered to the outside of the outer enclosure 1A by using the adhesive layer; then a light transmitting sheet 4A comprising PET resin and the like, for example, is wound and adhered on the outside of the outer enclosure 1A so as to cover the outer enclosures 5 and 6.

In this embodiment, the insulating ability between the outer electrodes 5 and 6 can be improved by forming an insulating coating having light transmitting properties, which is comprised of silicon varnish and the like, to the outside of the outer enclosure 1A, before winding the light transmitting sheet 4A onto the outside of the outer enclosure 1A.

Figure 6:
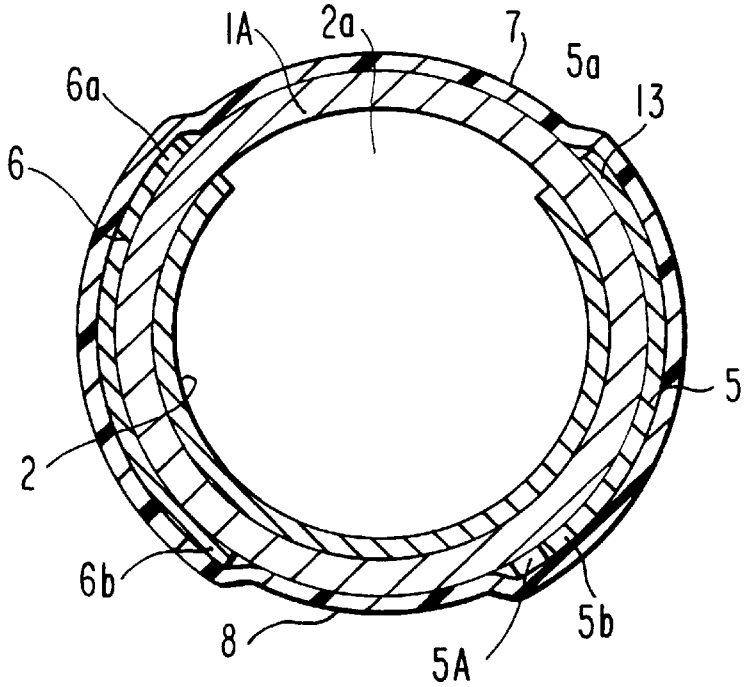
FIG. 6 is a cross-sectional diagram showing the noble gas discharge lamp of the fifth embodiment of the present invention.

FIG. 6 shows the fifth embodiment of the present invention, and the basic components of the noble gas discharge lamp shown in FIG. 6 are the same as those of the noble gas discharge lamp shown in FIG. 1.

However, they differ in the following point: After a pair of outer electrodes 5 and 6 are adhered to the outside of the outer enclosure 1A using the adhesive layer, a protective tube 13 comprising thermal shrinking resin, such as PET resin and the like, is covered thereon and shrunk with heat so that the outer electrodes 5 and 6 are covered with the protective tube 13.

Moreover, after the protective tube 13 is fit to the outside of the outer enclosure 1A, the protective tube 13 can be forcibly contacted to the outside of the outer enclosure 1A by heating them to approximately 150 to 200° C., and the protective tube 13 is made to shrink by heat.

Compared to the above-mentioned embodiments, manufacturing and working efficiency in this embodiment are not as good. However, because the adhesive layer is not used, erosion does not occur due to the reaction between the material comprising the terminals 51 and 61 and the adhesive composition comprising the adhesive layer. Therefore, stable travel conditions in the noble gas discharge lamp can be maintained for long periods. In addition, the joint portion is not formed in the protective tube 13; therefore, the peeling off of a laminated portions of the protective tube 13 can be prevented, as the light transmitting sheet 4 and 4A in the aforementioned embodiments.

In particular, the insulating ability between the outer electrodes 5 and 6 can be improved more effectively by forming an insulating coating having light transmitting properties, which is comprised of silicon varnish and the like, to the outside of the outer enclosure 1A, before covering the protective tube 13 over the outside of the outer enclosure 1A.

Figure 7:
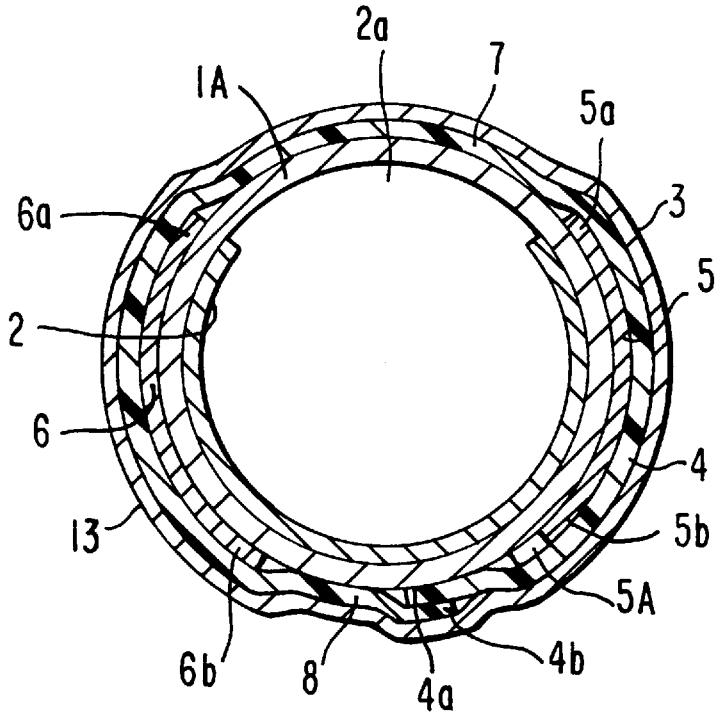
FIG. 7 is a cross-sectional diagram showing the noble gas discharge lamp of the sixth embodiment of the present invention.

FIG. 7 shows the sixth embodiment of the present invention, and the basic components of the noble gas discharge lamp shown in FIG. 7 are the same as those of the noble gas discharge lamp shown in FIG. 1.

However, they differ in the following point: After fitting a protective tube 13 over the outside of the outer laminate 3, which is comprised of thermal shrinking resins, such as PET resin, and the like, the protective tube 13 is made to shrink with heat.

Moreover, after the protective tube 13 is fit over the outside of the outer laminate 3 provided on the outside of the outer enclosure 1A, the protective tube 13 can be contacted forcibly to the outside of the light transmitting sheet 4 by heating them to approximately 150° C. to 200° C., and the protective tube 13 is made to shrink by heat.

In this embodiment, even if the noble gas discharge lamp is used under extreme conditions, or in situations requiring high safety standards, products having high quality can be produced by covering the outer laminate 3 with protective tube 13 having high heat-resistance and light transmitting properties.

In particular, the characteristic structure of this embodiment can be applied to the noble gas discharge lamps shown in FIGS. 3 to 6.

Moreover, the light transmitting sheet 4 and 4A and the protective tube 13 may be omitted in these embodiments.

In the following, preferred embodiments of the nonlinear portion will be explained. As described above, the nonlinear portion is formed at at least one side of a pair of the outer electrodes, in which some projections project toward the opposite electrode. Among many possible kinds of the nonlinear portions, the nonlinear portions shown in FIGS. 8 to 13 are preferable.

Figure 8:
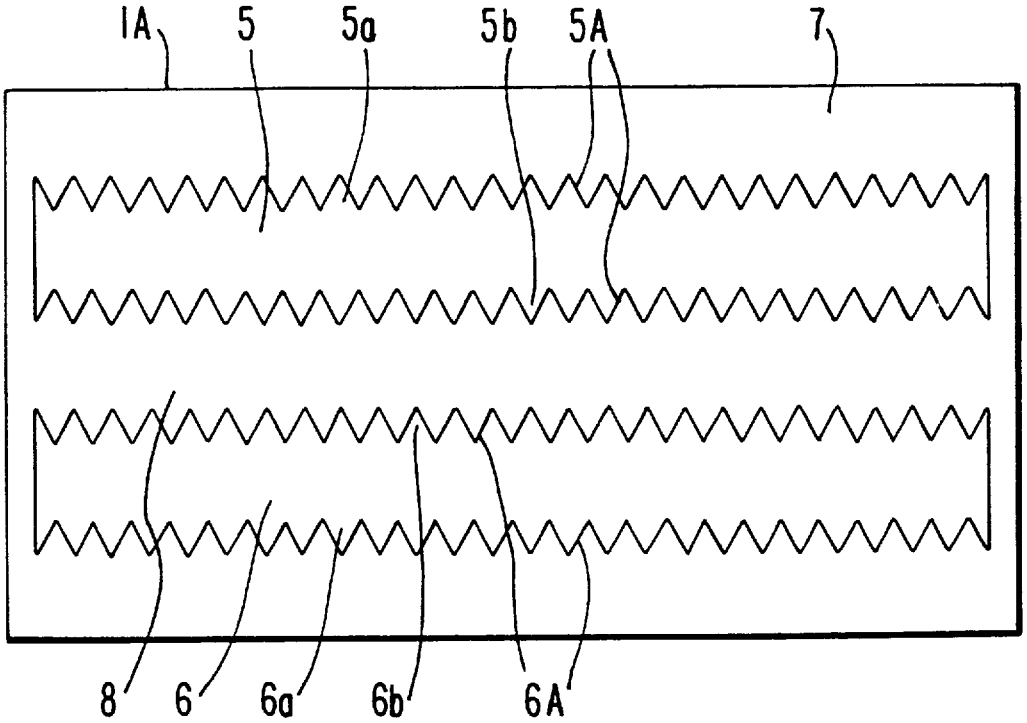
FIG. 8 is a schematic view showing the outer enclosure and outer electrodes used in the seventh embodiment of the present invention.

FIG. 8 shows the seventh embodiment of the present invention, and shows unfolding of outer enclosure 1A. The basic components of the noble gas discharge lamp shown in FIG. 8 are the same as those of the noble gas discharge lamp shown in FIG. 1.

However, they differ in the following points:

The nonlinear portions 5A and 6A are formed at the side portions 5*a,* 5*b,* 6*a,* and 6*b* of a pair of the outer electrode 5 and 6 which have a tape shape and are positioned at the outside of the outer enclosure 1A. Moreover, the nonlinear portions 5A and 6A, that is, the side portions 5*a,* 5*b,* 6*a,* and 6*b* form the first and second opening portions 7 and 8. The nonlinear portions 5A and 6A are in a series of repeated triangles.

Moreover, the interval between the peaks of the nonlinear portions 5A and 6A is fixed along the longitudinal direction of the outer electrodes 5 and 6.

In this embodiment, the nonlinear portions 5A and 6A are formed at all side portions 5*a,* 5*b,* 6*a,* and 6*b* of the outer electrodes 5 and 6; therefore, when a high voltage of high frequency is applied to the noble gas discharge lamp of this embodiment, the electrical field is remarkably concentrated at the peaks of the nonlinear portions 5A and 6A, and the starting characteristics thereof can be improved. In particular, when the peaks of the nonlinear portions 5A and 6A correspond to each other, the starting characteristics thereof can be effectively improved.

Figure 9:
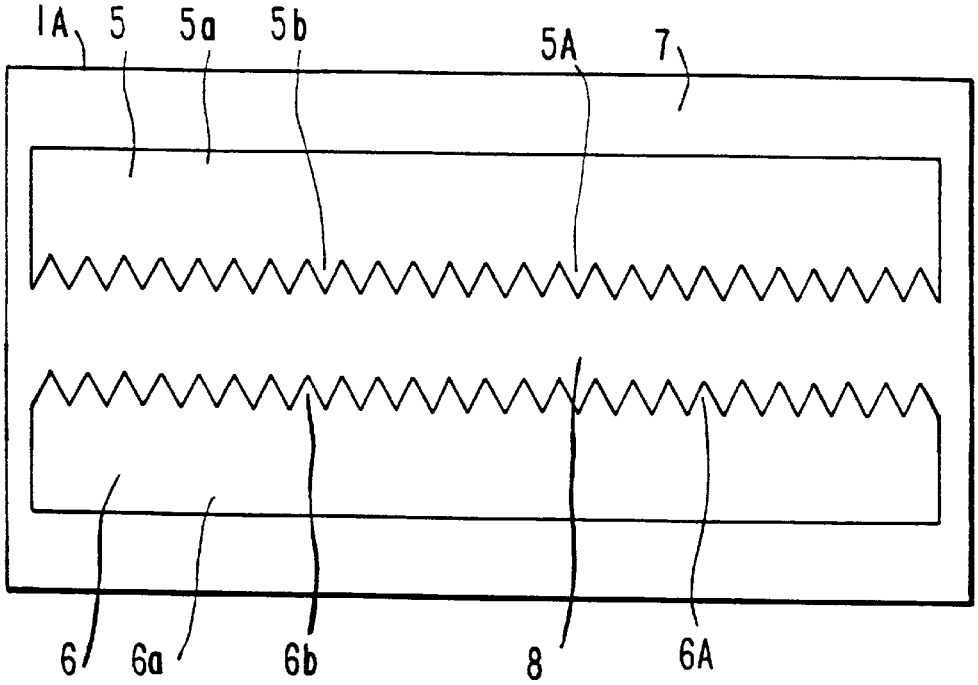
FIG. 9 is a schematic view showing the outer enclosure and outer electrodes used in the eighth embodiment of the present invention.

FIG. 9 shows the eighth embodiment of the present invention, and shows unfolding of outer enclosure 1A. The basic components of the noble gas discharge lamp shown in FIG. 9 are the same as those of the noble gas discharge lamp shown in FIG. 1.

However, they differ in the following points:

The nonlinear portions 5A and 6A are formed at the side portions 5*b* and 6*b* (they form the second opening portion 8) of a pair of the outer electrodes 5 and 6 having a tape shape which are positioned at the outside of the outer enclosure 1A. The nonlinear portions 5A and 6A are in a series of repeated triangles. The side portions 5*a* and 6*a* forming the first opening portion 7 are formed linearly.

In this embodiment, the side portions 5*a* and 6*a* forming the first opening portion 7 are formed linearly; therefore, illumination on the document can be approximately uniform. As a result, the precision of scanning of an illuminated document can be improved.

Figure 10:
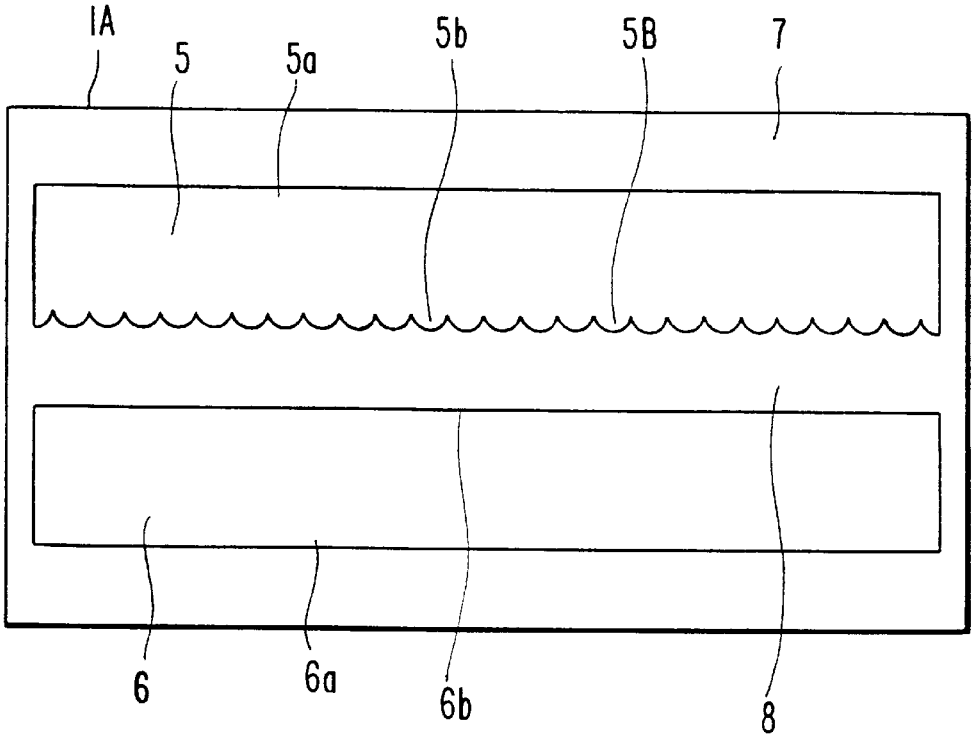
FIG. 10 is a schematic view showing the outer enclosure and outer electrodes used in the ninth embodiment of the present invention.

FIG. 10 shows the ninth embodiment of the present invention, and shows unfolding of outer enclosure 1A. The basic components of the noble gas discharge lamp shown in FIG. 10 are the same as those of the noble gas discharge lamp shown in FIG. 1.

However, they differ in the following points:

The nonlinear portion 5B is formed at only side portion 5*b* from among the side portions 5*b* and 6*b* forming the second opening portion 8. The nonlinear portion 5B is in a wave shape, for example, a series of repeated semicircles. The side portion 6*b* being opposite to the side portion 5*b,* that is, the nonlinear portion 5B, is formed linearly.

Moreover, the remaining side portions 5*a,* 6*a,* and 6*b* beside the side portion 5*b* are entirely formed linearly.

In this embodiment, when a high voltage of high frequency is applied to the outer electrodes 5 and 6, discharges occur between the nonlinear portion 5B (side portion 5*b*) and the side portion 6*b* linearly; however, the positioning of the outer electrodes 5 and 6 is not restricted, because the side portion 6*b* is formed linearly. Therefore, assembly of the noble gas discharge lamp can be improved.

Figure 11:
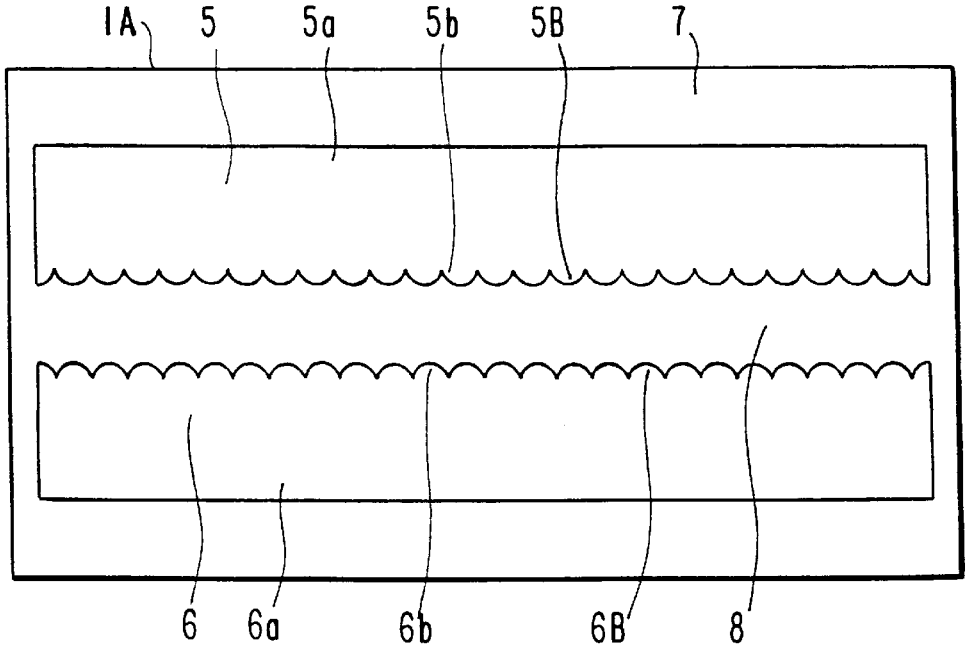
FIG. 11 is a schematic view showing the outer enclosure and outer electrodes used in the tenth embodiment of the present invention.

FIG. 11 shows the tenth embodiment of the present invention, and shows unfolding of outer enclosure 1A. The basic components of the noble gas discharge lamp shown in FIG. 11 are the same as those of the noble gas discharge lamp shown in FIG. 1.

However, they differ in the following points:

The nonlinear portions 5B and 6B are formed at the side portions 5*b* and 6*b* (they form the second opening portion 8) of a pair of the outer electrodes 5 and 6. The nonlinear portions 5A and 6A are in a wave shape, for example, a series of repeated semicircles. The side portions 5*a* and 6*a* forming the first opening portion 7 are formed linearly.

Moreover, the nonlinear portions 5B and 6B may be formed at all side portions 5*a,* 5*b,* 6*a,* and 6*b.* That is, all the side portions 5*a,* 5*b,* 6*a,* and 6*b,* may be formed in a series of repeated semicircle.

Figure 12:
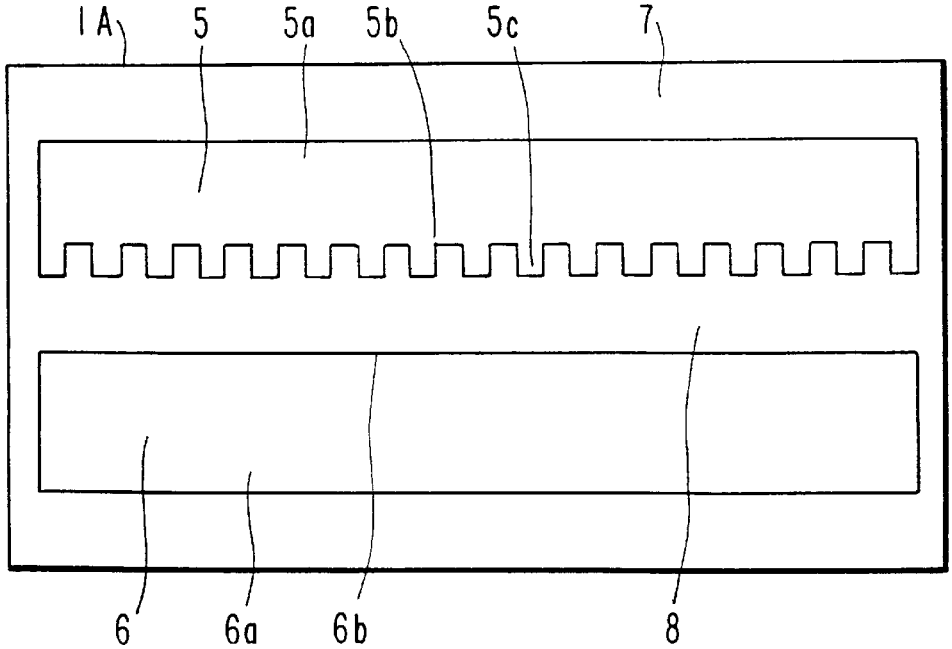
FIG. 12 is a schematic view showing the outer enclosure and outer electrodes used in the eleventh embodiment of the present invention.

FIG. 12 shows the eleventh embodiment of the present invention, and shows unfolding of outer enclosure 1A The basic components of the noble gas discharge lamp shown in FIG. 12 are the same as those of the noble gas discharge lamp shown in FIG. 1.

However, they differ in the following points:

The nonlinear portion 5C is formed at only the side portion 5*b* from among side portions 5*b* and 6*b* forming the second opening portion 8. The nonlinear portion 5C is in a series of repeated polygons, such as rectangles and trapezoids.

The side portion 6*b* being opposite to the side portion 5*b* is formed linearly.

Moreover, the remaining side portions 5*a,* 6*a,* and 6*b* of the outer electrodes 5 and 6 beside the side portion 5*b* of the outer electrode 5 are formed linearly.

Figure 13:
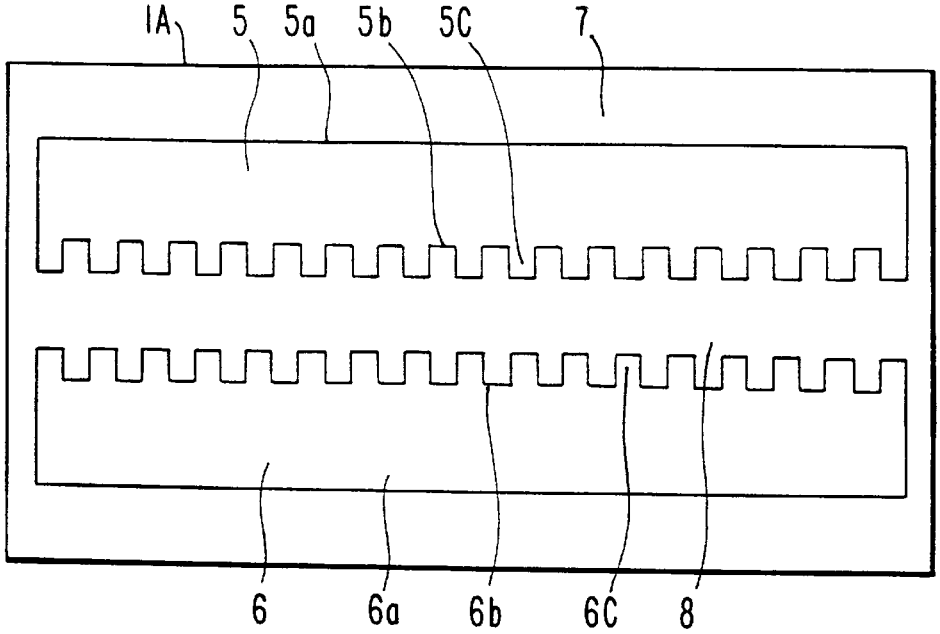
FIG. 13 is a schematic view showing the outer enclosure and outer electrodes used in the twelfth embodiment of the present invention.
Figure 14:
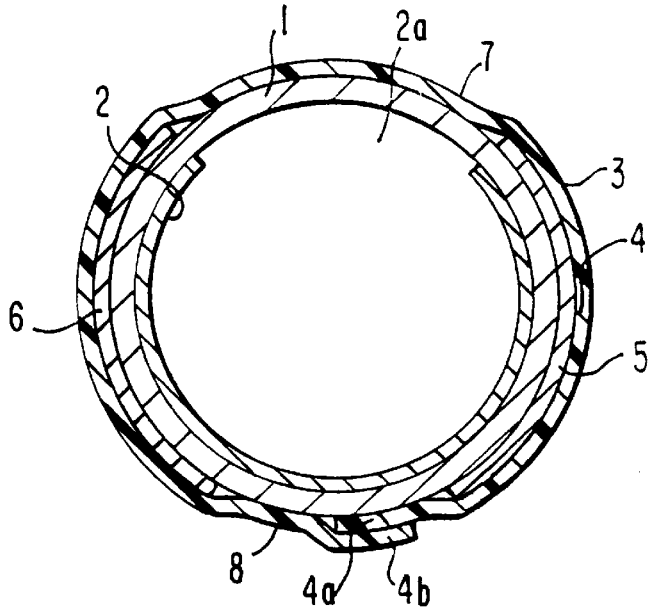
FIG. 14 is a cross-sectional diagram showing a background noble gas discharge lamp.
Figure 15:
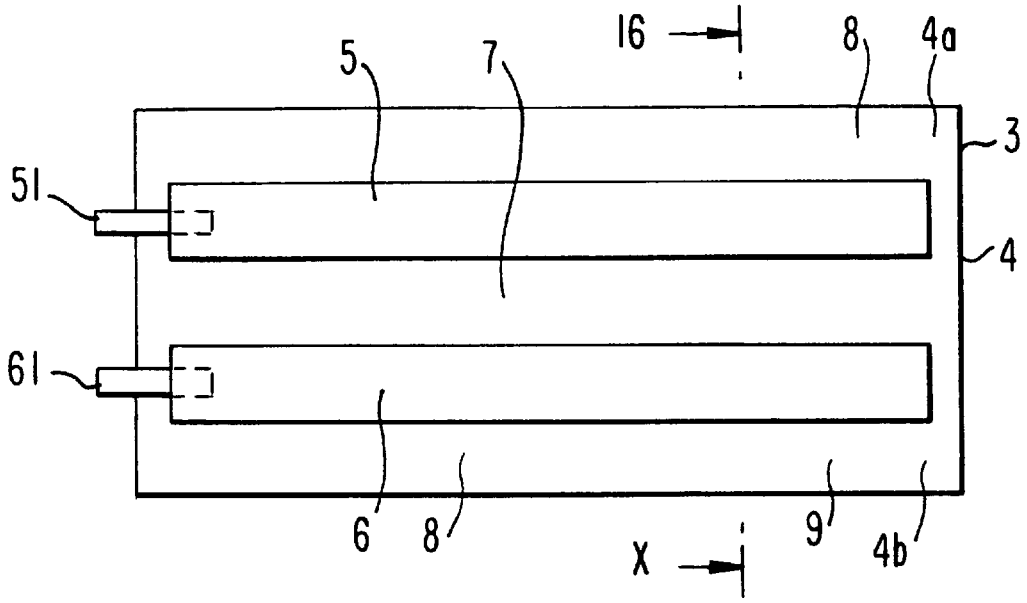
FIG. 15 is a schematic view showing the outer laminate shown in FIG. 14.
Figure 16:
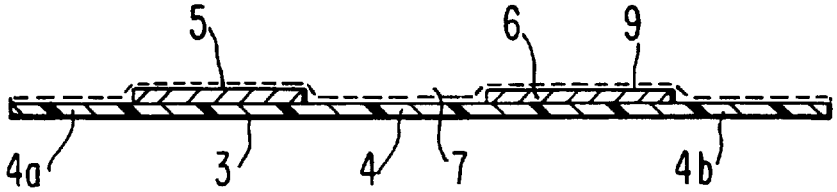
FIG. 16 is a cross-sectional diagram taken along line X—X in FIG. 15.

FIG. 13 shows the twelfth embodiment of the present invention, and shows unfolding of outer enclosure 1A. The basic components of the noble gas discharge lamp shown in FIG. 13 are the same as those of the noble gas discharge lamp shown in FIG. 1.

However, they differ in the following points:

The nonlinear portions 5C and 6C are formed at the side portions 5*b* and 6*b* forming the second opening portion 8. The nonlinear portions 5C and 6C are in a series of repeated polygons, specifically, rectangles.

The side portions 5*a* and 6*a* forming the first opening portion 7 are formed linearly.

Moreover, the nonlinear portions 5C and 6C may be formed at all side portions 5*a,* 5*b,* 6*a,* and 6*b.* That is, all side portions 5*a,* 5*b,* 6*a,* and 6*b* may be formed in a series of repeated polygons, such as rectangles.

In particular, at least one of the outer electrodes 5 and 6 having the above-mentioned nonlinear portion 5A, 5B, 5C, 6A, 6B and 6C can be applied to the noble gas discharge lamps shown in FIGS. 1 to 7 in suitable combinations.

Moreover, the pitch and the height of the nonlinear portions 5A, 5B, 5C, 6A, 6B and 6C can be modified, depending on the size of the noble gas discharge lamp.

Experimental Examples

The present invention will now be explained using experimental examples.

Experimental Example 1

The fluorescent water-soluble coating solution containing fluorescent cerium.terbium activated yttrium.silicate ($Y_2SiO_5$: Ce, Th) having an emission spectrum in yellow-green wavelengths was obtained.

Next, the light emitting layer 2 was formed by coating the obtained fluorescent water-soluble coating solution on the inside of the outer enclosure 1A comprised of lead glass, which was 8 mm in external diameter, 0.5 mm in thickness, and 360 mm in length. Moreover, the coating amount of the fluorescent water-soluble coating solution was 15 mg/cm$^2$.

Then, the aperture 2*a* having 75° in the opening angle $\theta_3$ was obtained by forcibly peeling off a part of the obtained light emitting layer 2 using a scraper.

The outer enclosure 1A was sealed, and filled with xenon gas at a confining pressure being varied in a range of 70 to 230 Torr.

Figure 17:
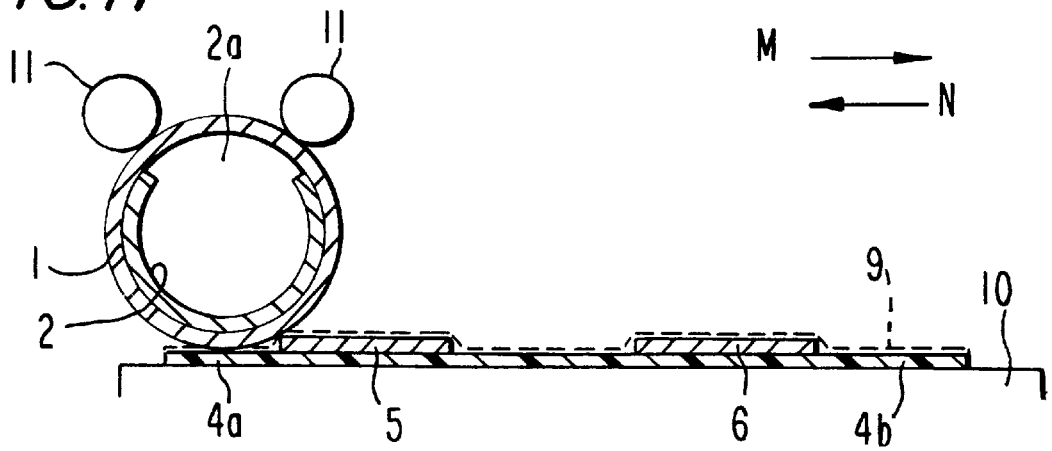
FIG. 17 is a schematic view showing the process for producing the noble gas discharge lamp shown in FIG. 14.

Then, the noble gas discharge lamps of this Experimental Example were produced by the same steps shown in FIGS. 17. Moreover, a pair of the outer electrodes 5 and 6 was comprised of aluminum foil in the shape of a tape 8 mm in width. As shown in FIG. 2, the nonlinear portion 5A was formed at only one side portion 5*b* of the outer electrode 5 forming the second opening portion 8, in which triangles 4 mm in pitch and 1.5 mm in peak height were formed.

Next, the following measurement was carried out on the noble gas discharge lamps obtained in this Experimental Example.

(1) The electrical discharge occurring voltage (starting voltage)

Figure 18:
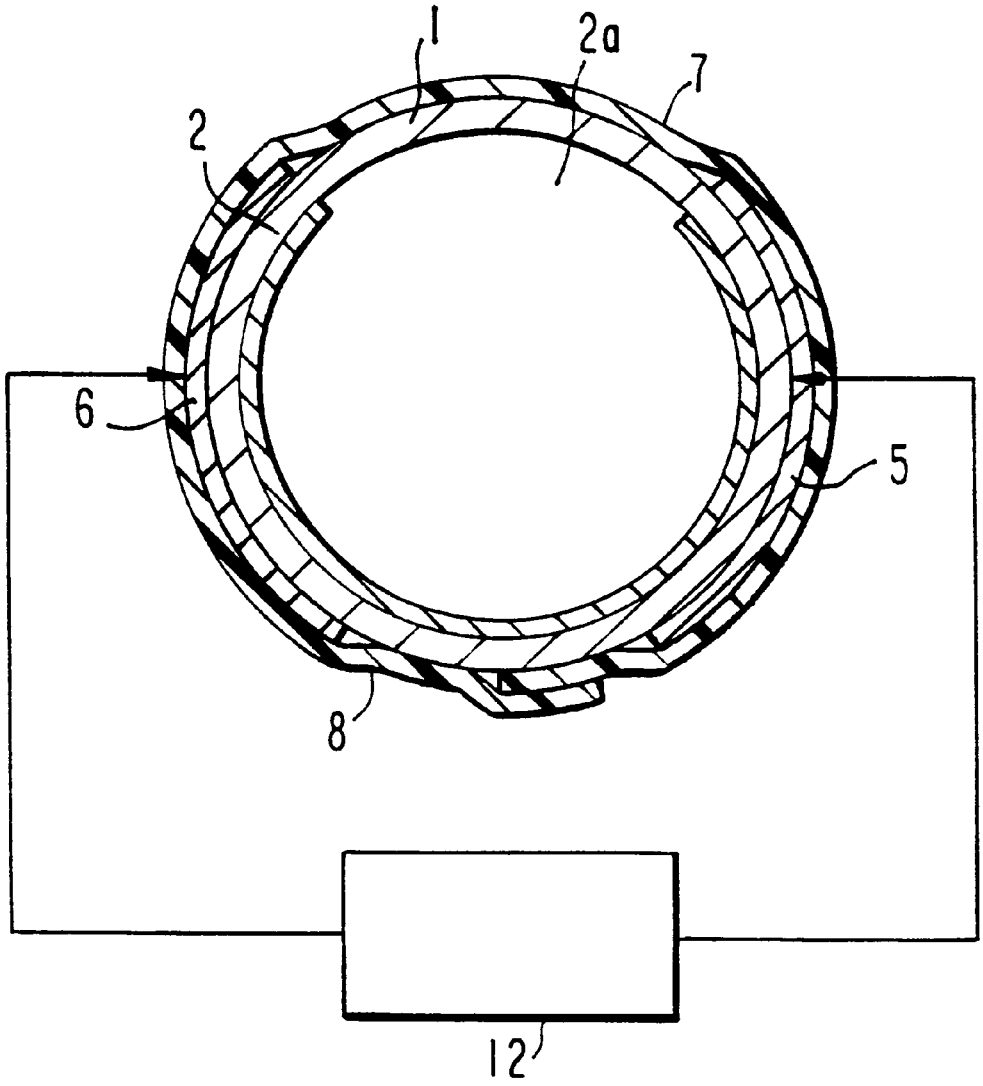
FIG. 18 is a schematic view showing an electric circuit of a noble gas discharge lamp.

The obtained noble gas discharge lamps were incorporated in an electric circuit as shown in FIG. 18, and the output voltage (frequency fixed at 30 kHz, voltage 2500 $V_{o\text{-}p}$) of the inverter circuit 12 were gradually increased. Then, the voltages at which discharge occurred (starting voltages) were measured in which the intermittent illumination was not confirmed. The results of these measurements were shown in the following Table 1.

TABLE 1

| Confining Pressure of Xenon Gas (Torr) | Starting Voltages (V) |
|---|---|
| 70 | 1750 |
| 83 | 2000 |
| 90 | 2000 |
| 100 | 2000 |
| 110 | 2250 |
| 120 | 2250 |
| 150 | 2250 |
| 200 | 2250 |
| 210 | 2500 |
| 230 | 2500 |

As shown in Table 1, the following points were clear.

When the confining pressure of xenon gas is 200 Torr or less, even when the output voltage (frequency fixed at 30 kHz) of the inverter circuit 12 was set to 90% of a fixed voltage (2500 $V_{o\text{-}p}$), the intermittent illumination cannot be confirmed, and stable travel of electric discharge can be obtained after the lamps are lit. Compared with the conventional noble gas discharge lamp which does not comprise the nonlinear portion 5A, the starting voltage in a range of 300 to 600V can be decreased in the noble gas discharge lamp of this Experimental Example.

When the confining pressure is 83 Torr or greater in the conventional noble gas discharge lamp, the intermittent illumination can be confirmed. In addition, when the confining pressure reaches 100 Torr, the conventional noble gas discharge lamp cannot be used in practice without difficulty.

In the case of more than 200 Torr, specifically 210 Torr and 230 Torr, the lamps can be lit with a fixed voltage (2500 $V_{o\text{-}p}$); however, start-up is not assured when the input power was decreased.

Moreover, the following measurements were carried out for the noble gas discharge lamps obtained in this Experimental Example.

(1) Illumination intensity of the document

The obtained noble gas discharge lamps were incorporated in an electric circuit as shown in FIG. 18, and the output voltage (frequency fixed at 30 kHz) of the inverter circuit 12 was set to 90% of a fixed voltage (2500 $V_{o\text{-}p}$). In these conditions, the illumination intensities on the document were measured at a point 8 mm away from the outer enclosure 1. The results were shown in the following Table 2.

(2) Occurrence of intermittent illumination

The obtained noble gas discharge lamps were incorporated in an electric circuit as shown in FIG. 18, and the output voltage (frequency fixed at 30 kHz) of the inverter circuit 12 was set to 90% of a fixed voltage (2500 Vp). In these conditions, the occurrence of intermittent illumination was evaluated at a point 8 mm away from the outer enclosure. The results were shown in the following Table 2.

In Table 2, ○ means that intermittent illumination did not occur, Δ means that some intermittent illumination did occur, but the noble gas discharge lamp can be used in practice without difficulty, and X means that intermittent illumination did occur, and the noble gas discharge lamp cannot be used in practice without difficulty.

TABLE 2

| Confining Pressure of Xenon Gas (Torr) | Illumination intensity on the document (Lx) | Occurrence of intermittent illumination |
|---|---|---|
| 70 | 13000 | ○ |
| 83 | 15000 | ○ |
| 90 | 16000 | ○ |
| 100 | 16500 | ○ |
| 110 | 17000 | ○ |
| 120 | 17500 | ○ |
| 150 | 19000 | ○ |
| 200 | 19500 | Δ |
| 210 | (20000) | X |
| 230 | (21000) | X |

As shown in Table 2, the following points were clear.

When the confining pressure of xenon gas is 150 Torr or less, a stable travel of electric discharge without occurrence of intermittent illumination can be obtained. When the confining pressure of xenon gas is 200 Torr, some intermittent illumination did occur, but the noble gas discharge lamp can be used in practice without difficulty. However, in the case the confining pressure being more than 200 Torr, specifically 210 Torr and 230 Torr, the significant intermittent illumination occurs, and it is confirmed that it is difficult to use the noble gas discharge lamps in an illumination device.

Moreover, the illumination intensity on the illuminated document increases, depending on an increase of the confining pressure of xenon gas; however, a stable illumination intensity without occurrence of intermittent illumination can be obtained when the confining pressure of xenon gas is in a range of 200 Torr or less.

Therefore, it is clear from Table 2 that the confining pressure of noble gas is suitable in a range of 83 to 200 Torr.

Experimental Example 2

Noble gas discharge lamps were produced in the same way as in Experimental Example 1. However, the confining pressure of xenon gas was fixed at 120 Torr, and the thickness of the outer enclosure 1A was varied in a range of 0.18 to 0.8 mm as shown in the following Table 3.

Next, the following measurements were carried out for the noble gas discharge lamps obtained in this Experimental Example.

(1) Occurrence of intermittent illumination

The obtained noble gas discharge lamps were incorporated in an electric circuit as shown in FIG. 18, and the output voltage (frequency fixed at 30 kHz) of the inverter circuit 12 was set to 90% of a fixed voltage (2500 $V_{o-p}$). In these conditions, the occurrence of intermittent illumination was evaluated at a point 8 mm away from the outer enclosure. The results were shown in the following Table 3.

In Table 3, ○ means that intermittent illumination did not occur, Δ means that some intermittent illumination did occur, but the noble gas discharge lamp can be used in practice without difficulty, and X means that intermittent illumination did occur, and the noble gas discharge lamp cannot be used in practice without difficulty.

(2) Presence of damage in producing steps (Strength)

In production steps, the presence of damage in the outer enclosures of the obtained noble gas discharge lamps was evaluated.

In Table 3, ○ means that damage to the outer enclosure was not observed, and the strength of the outer enclosure is sufficient; Δ means that some damage was observed in the outer enclosure, but the noble gas discharge lamps comprising the outer enclosures were at least usable; and X means that serious damage to the outer enclosure was observed and the strength of the outer enclosure meant the produced noble gas discharge lamps would be difficult to use.

TABLE 3

| Thickness of the outer enclosure (mm) | Occurrence of intermittent illumination | Strength |
|---|---|---|
| 0.18 | ○ | X |
| 0.2 | ○ | Δ |
| 0.25 | ○ | Δ |
| 0.4 | ○ | ○ |
| 0.5 | ○ | ○ |
| 0.6 | ○ | ○ |
| 0.7 | Δ | ○ |
| 0.8 | X | ○ |

As shown in Table 3, the following points were clear.

When the thickness of the outer enclosure 1A is in a range of 0.18 to 0.6 mm, the occurrence of intermittent illumination cannot be confirmed, even when the output is low.

When the thickness is 0.7 mm, some intermittent illumination was confirmed; however, the noble gas discharge lamp can be used in practice without difficulty.

However, when the thickness is 0.8 mm, significant intermittent illumination was confirmed, and the effects obtained by forming the nonlinear portion 5A were decreased.

Moreover, when the thickness of the outer enclosure is 0.4 mm or greater, damage cannot be confirmed in the production.

When the thickness is less than 0.4 mm, especially 0.25 mm and 0.2 mm, damage was observed. In particular, when the thickness is 0.18 mm, damage suddenly increases; therefore, it is confirmed that mechanical strength is low, and they are unsuitable for producing in large quantities.

Therefore, as shown in Table 3, the thickness of the outer enclosure is preferably in a range of 0.2 to 0.7 mm, more preferably in a range of 0.4 to 0.7 mm.

What is claimed is:

1. A noble gas discharge lamp comprising:

an outer enclosure comprising a light emitting layer formed therein, and a pair of outer electrodes having tape shapes comprising a metal, which are adhered to the entire length of the outside of the outer enclosure so as to separate one outer electrode and the other outer electrode at a certain distance, and to form a first opening portion and a second opening portion;

wherein the thickness of the outer enclosure is in a range of 0.2 to 0.7 mm, and at least one nonlinear portion is formed at at least one side portion of the outer electrodes.

2. A noble gas discharge lamp according to claim 1, wherein light emitted from the light emitting layer is mainly emitted from the first opening portion, and at least one nonlinear portion is formed at at least one side portion of a pair of the outer electrodes forming the second opening portion.

3. A noble gas discharge lamp according to claim 2, wherein an insulating material is coated on the outside of the outer enclosure so as to cover the outer electrodes.

4. A noble gas discharge lamp according to claim 3, wherein the insulating material is at least one material selected from the group consisting of a protective tube comprising thermal shrinking resin and a light transmitting sheet.

5. A noble gas discharge lamp according to claim 1, the noble gas discharge lamp comprising the outer enclosure in a straight tube shape, and the outer laminate, the outer laminate comprising a light transmitting sheet, outer electrodes, and an adhesive layer, the light transmitting sheet have the same length as the outer enclosure, a pair of outer electrodes having tape shapes comprised of a metal positioned on one surface of the light transmitting sheet so as to separate one outer electrode and the other outer electrode the adhesive layer formed on the surface of the light transmitting sheet in which the outer electrodes are positioned, wherein the outer electrodes and the light transmitting layer are formed on the outside of the outer enclosure in sequence.

6. A noble gas discharge lamp according to claim 1, wherein the nonlinear portion is formed over the entire length of the outer electrode.

7. A noble gas discharge lamp according to claim 6, wherein the nonlinear portion is formed in a series of repeated shape, the shape being at least one of a triangle, a polygon, and a wave shape.

8. A noble gas discharge lamp according to claim 7, wherein the polygon is a trapezoid.

9. A noble gas discharge lamp according to claim 7, wherein the wave shape is in a series of repeated semicircles.

10. A noble gas discharge lamp according to claim 1, wherein an aperture is formed in the inside of the outer enclosure at a position corresponding to the first opening portion, in which the light emitting layer is not formed.

11. A noble gas discharge lamp according to claim 1, wherein the outer enclosure is filled with xenon gas.

* * * * *